US005936336A

United States Patent [19]

Shishido et al.

[11] Patent Number: 5,936,336

[45] Date of Patent: Aug. 10, 1999

[54] SHADOW MASK STRUCTURE FOR CATHODE RAY TUBE

[75] Inventors: Akira Shishido; Nobuyuki Tsuchiya, both of Shiga, Japan

[73] Assignee: NEC Corporation, Tokyo, Japan

[21] Appl. No.: 08/962,333

[22] Filed: Oct. 31, 1997

[30] Foreign Application Priority Data

Oct. 31, 1996 [JP] Japan ..... 8-289426

[51] Int. Cl.[6] ..... H01J 29/02

[52] U.S. Cl. ..... 313/402; 313/405; 313/404; 313/407

[58] Field of Search ..... 313/402, 404, 313/405, 407

[56] References Cited

U.S. PATENT DOCUMENTS 4,678,963 7/1987 Fonda ..... 313/405

5,680,004 10/1997 Ragland, Jr. ..... 313/407

5,717,280 2/1998 Lee ..... 313/404

5,780,962 7/1998 Fujii et al. ..... 313/402 X

FOREIGN PATENT DOCUMENTS 49-9581 3/1974 Japan .

*Primary Examiner*—Ashok Patel

*Attorney, Agent, or Firm*—Sughrue, Mion, Zinn, Macpeak & Seas, PLLC

[57] ABSTRACT

A positional relation between a fluorescent film 11 and a shadow mask 2 is maintained in the optimal state with respect to the thermal expansion of a face panel 10 by providing hook springs 5 of stainless steel on minor side wall portions 3*a* of a rectangular frame 3 for fixedly supporting the shadow mask and a hook spring 6 of bimetal on a major side lower wall portion 3*b* of the frame 3.

3 Claims, 5 Drawing Sheets

SHADOW MASK STRUCTURE FOR CATHODE RAY TUBE

BACKGROUND OF THE INVENTION

1. Field of the Invention

The present invention relates to a shadow mask structure for a cathode ray tube and, particularly, to a shadow mask structure for a cathode ray tube, which is provided with means for optomizing a relative positional relation between a face panel of glass and a shadow mask with respect to a variation of environmental temperature to restrict the mislanding.

2. Description of the Related Art

FIG. 5 is a partial cross section of a usual color cathode ray tube, showing a shadow mask structure mounted on an inner surface of a face panel of the tube.

As shown in FIG. 5, the shadow mask structure 1 comprises a shadow mask 2 having a number of fine through-holes 2*a* arranged in matrix for color selection, a frame 3 for reinforcing the shadow mask and hook springs 4 for mounting the shadow mask 2 inside a face panel 10 having a fluorescent film 11 formed thereon. The shadow mask 2 and the frame 3 are fixed to each other by such as welding in an overlapping portions 21 thereof. Each hook spring 4 takes in the form of metal piece of a material having the same temperature characteristics as that of the shadow mask and is fixed to an outer surface of the frame 3 by such as welding. The shadow mask structure 1 is fixedly mounted on the inner surface of the face panel 10 by fixedly fitting mounting holes 4*a* formed in end portions of the hook springs 4 on stud pins 20 provided on the inner surface of the face panel 10, respectively.

Now, the shadow mask structure 1 will be described.

FIG. 6 is a plan view of the shadow mask structure shown in FIG. 5 on the inner surface of the face panel when looked in a direction shown by arrows Y. As shown in FIG. 6, the shadow mask structure 1 is completed by partially overlapping a peripheral portion of the substantially rectangular metal frame 3 on a skirt portion 2*b* of the shadow mask 2, integrating the shadow mask 2 and the frame 3 by welding them at 8 points of a rectangular overlapped portion 21 thereof, 4 corners and intermediate points of sides of the overlapped rectangular peripheral portion and welding the hook springs 4 in the form of the metal pieces having the same temperature characteristics as that of the frame 3 to 3 points at both side wall portions 3*a* and a lower wall portion 3*b*. The end portions of the hook springs 4 are provided with the mounting holes 4*a*, respectively.

FIG. 7 is a partial cross section of the color cathode ray tube and shows a positional relation between the shadow mask 2 and a fluorescent film 11 formed on the face panel 10 thereof.

An electron beam 25 emitted from an electron gun (not shown) and deflected collides through the through-hole 2*a* of the shadow mask 2 with a film portion 11*a* of the fluorescent film 11 to excite the film portion 11*a* with a predetermined color. The frame 3 fixedly supporting the shadow mask 2 is fixedly supported by the hook springs 4 welded to the outer wall portion 3*a* of the frame 3 as shown in FIG. 5 and the stud pins 20 provided on the inner surface of the face panel 10.

In general, the shadow mask 2 and the frame 3 are made of iron containing materials. Therefore, their temperature is increased by bombardment of the electron beam 25 and the shadow mask 2 and the frame 3 are expanded to positions indicated in FIG. 7 by 2*d* and 3*d*, respectively.

Since the frame 3 is formed by using a plate material which is thicker than the shadow mask 2 and has larger thermal capacity, it expands thermally at low rate until thermal equilibrium is established. Thus, the through-hole 2*a* in the peripheral portion of the shadow mask 2 move outward to a position shown by 2*e*.

Therefore, the path of electron beam passing through the through-hole 2*a* to the predetermined film portion 11*a* of the fluorescent film 11 can not be established and the electron beam 25*a* passed through the through-hole 2*e* hits a film portion 11*b* remote from the predetermined film portion 11*a*. That is, the electron beam mislands, causing the color purity characteristics of the color cathode ray tube to be degraded.

Such thermal expansion of the shadow mask is called "whole doming". In a color cathode ray tube disclosed in Japanese Patent Publication (A2) No. Sho 49-9581, the whole doming phenomenon is relaxed by forming the hook springs from bimetal pieces to move the thermally expanded shadow mask toward the fluorescent film 11.

As also shown in FIG. 7, when the hook springs are formed from bimetal pieces, the position 3*a* of the frame 3 moves toward a position 3*e* and the position 2*e* of the through-hole is shifted to a position 2*f*. Therefore, an electron beam path passing through the through-hole 2*f* to the predetermined film portion 11*a* can be established.

In order to restrict the doming phenomenon, there is a current tendency of forming the shadow mask of an alloy such as invar which has a smaller thermal expansion coefficient than that of iron. Further, when the springs are of a spring steel such as SUS304 or SUS301, the doming phenomenon of the shadow mask is reduced to one third of that obtainable with the shadow mask of iron material.

In a color cathode ray tube such as mentioned above, the shadow mask 2 formed from invar material having small thermal expansion coefficient is free from thermal expansion due to environmental temperature variation. However, in a high definition display used in a terminal device, the thermal expansion phenomenon caused by environmental temperature variation of the face panel which is of glass having large thermal expansion coefficient compared with the shadow mask 2 becomes unable to be neglected and, when the display operates, heat is generated by a deflection yoke of the cathode ray tube and circuit portions of the display and transmitted upward by convection. Therefore, temperature in an upper portion of the display becomes higher than that in a lower portion thereof, which means that an upper portion of the face panel is easily expanded thermally compared with a lower portion thereof. Therefore, an amount of mislanding of electron beam in the upper portion of the face panel, that is, in an upper portion of a screen, becomes larger and, further, there is unbalance occurred in an image quality between the upper and lower portions of the screen.

FIGS. 8(*a*) and 8(*b*) are illustrations for explaining a principle of mislanding caused by environmental temperature variation of the color cathode ray tube. As shown in FIG. 8(*a*), at a certain constant temperature, the electron beam 25 passed through the through-hole 2*a* of the shadow mask 2 impinges the predetermined film portion 11*a* of a fluorescent film 11 on the inner surface of the face panel.

However, when the environmental temperature becomes higher than the certain constant temperature, the fluorescent film 11 is moved to a position 12 due to thermal expansion of the face panel 10 (not shown) and the predetermined film portion 11*a* moves the film portion 12*a*. Since the thermal expansion of the shadow mask 2 formed of invar material is very small, the electron beam 25 passed through the through-hole 2*a* impinges not the predetermined film portion 12*a* but the film portion 12*b* remote from the portion 12*a*.

On the contrary, when the environmental temperature becomes lower than the constant temperature, the fluorescent film 11 is moved to a position 13 due to thermal shrinkage of the face panel 10 (not shown) and thus the predetermined film portion 11 is moved to a position 13 and the predetermined film portion 11*a* is moved to a film portion 13*a*. Since the thermal shrinkage of the shadow mask 2 itself is very small and substantially negligible, the electron beam 25 passed through the through-hole 2*a* impinges not the desired film portion 13*a* but the film portion 13*b* remote from the film portion 13*a*.

SUMMARY OF THE INVENTION

An object of the present invention is to provide a shadow mask structure of a color cathode ray tube, which is equipped with means for maintaining a distance between a face panel of the cathode ray tube and the shadow mask arranged against the face panel constant even when the face panel is thermally expanded to minimize the mislanding of electron beam and balance display quality on an upper and lower limit regions of a screen of the cathode tube.

In order to achieve the above object, according to the present invention, a shadow mask structure of a cathode ray tube, which includes a shadow mask arranged on an inner face of a face panel of the cathode ray tube with a constant distance between them, a rectangular frame for fixedly supporting the shadow mask and a plurality of hook sprigs for fixedly mounting the frame on the face panel, is featured by that the hook springs arranged on minor side walls of the rectangular frame and those arranged on major side lower or upper wall thereof are formed of materials having different temperature characteristics.

The hook springs arranged on the minor side walls of the frame may be of stainless steel and the hook springs arranged on the major upper or lower walls thereof are of bimetal.

Alternatively, the hook springs arranged on the minor side walls of the frame may be of bimetal and the hook springs arranged on the major upper or lower walls thereof are of stainless steel.

BRIEF DESCRIPTION OF THE DRAWINGS

FIG. 8(*b*) is an illustration for explaining an operation principle of a conventional color cathode ray tube when an environmental temperature is lower than the reference temperature.

DETAILED DESCRIPTION OF THE PREFERRED EMBODIMENTS

Figure 1:
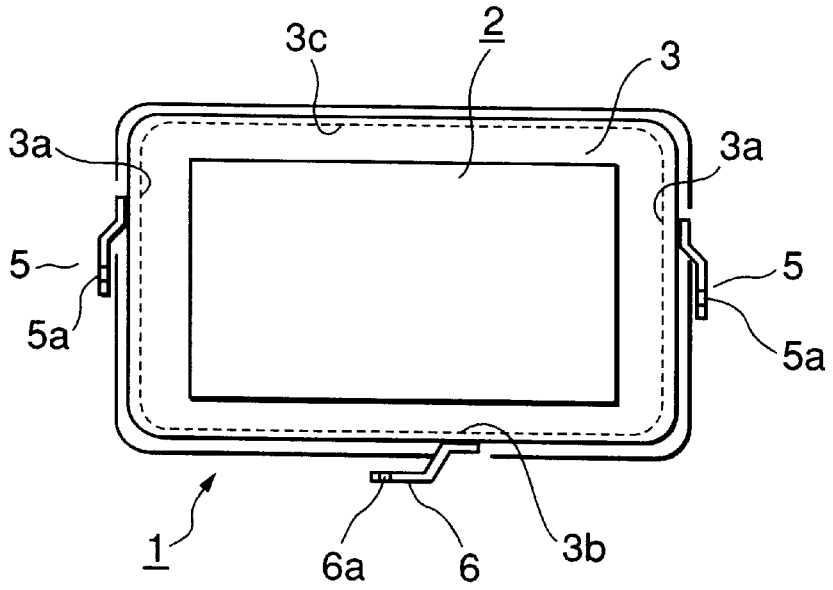
FIG. 1 is a plan view of a shadow mask structure according to a first embodiment of the present invention.

Embodiments of the present invention will be described with reference to the drawings.

In FIGS. 1 to 5, a reference numeral 1 depicts a shadow mask structure, 2 a shadow mask, 3 a rectangular frame, 5 hook springs of stainless steel, 6 hook springs of bimetal, 3*a* minor side wall portions of the rectangular frame, 3*b* a major side lower wall portion of the rectangular frame and 3*c* a major side upper wall portion of the rectangular frame. Incidentally, the same structural components of the present invention as those of the conventional structure are depicted by the same reference numerals, respectively, without detailed description thereof.

FIG. 1 is a plan view of a shadow mask structure according to a first embodiment of the present invention. As shown in FIG. 1, the shadow mask structure 1 of the present invention is constructed by welding together overlapping portions of a shadow mask 2 and a rectangular frame 3, welding hook springs 5 of stainless steel to minor side wall portions 3*a* of the rectangular frame such that mounting holes 5*a* of the hook springs 5 are positioned at substantial centers of the respective minor side wall portions and welding the hook springs 6 of bimetal to a major lower wall portion 3*b* of the rectangular frame 3 such that a mounting hole 6*a* is positioned at a substantial center of the major side wall 3*b*.

The feature of the present invention resides in that the hook springs 5 arranged on the minor side wall portions 3*a* are formed of one material and the hook spring 6 arranged on the major side wall portion 3*b* is formed of another material whose temperature characteristics is different from the one material. In concrete, the hook springs 5 of stainless steel are arranged on the minor side walls 3*a* of the frame 3 and the hook spring 6 of bimetal is arranged on the major side lower wall portion 3*b* of the frame 3.

Figure 2:
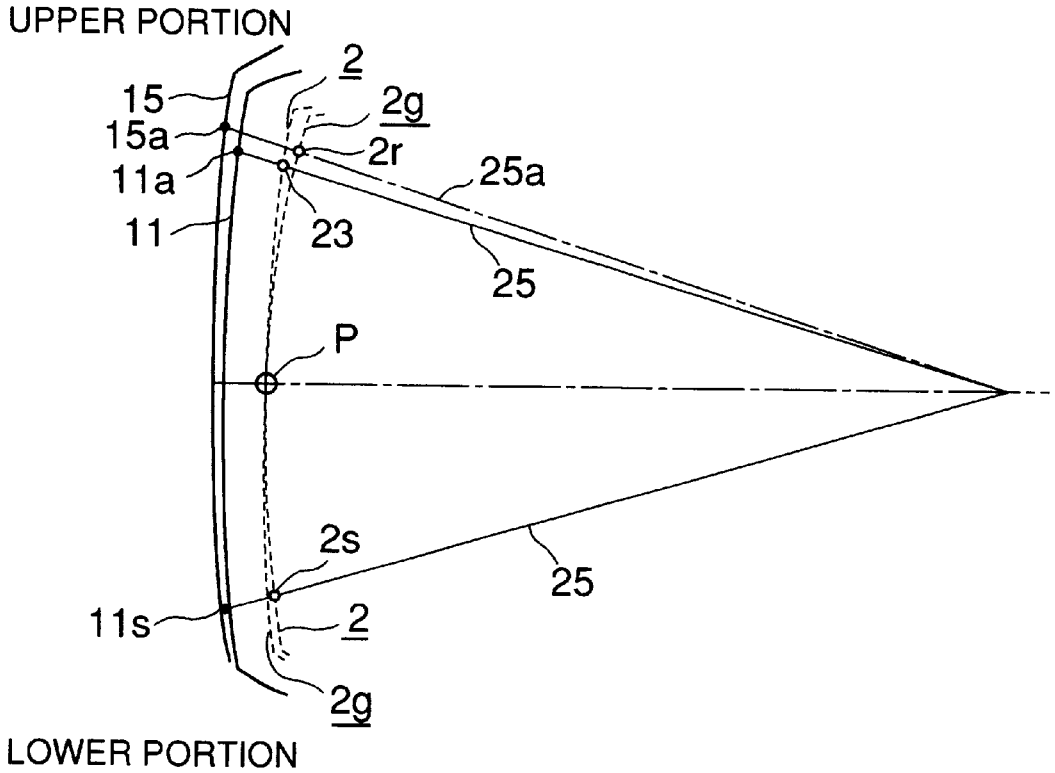
FIG. 2 is an illustration for explaining an operation principle of the shadow mask structure when environmental temperature varies.

FIG. 2 is an illustration for explaining the operation principle of the shadow mask structure of the present invention when the environmental temperature is varied. As shown in FIG. 2, at a certain constant temperature, an electron beam 25 passed through a through-hole 2*a* of the shadow mask 2 impinges a predetermined film portion 11*a* of a fluorescent film 11 formed on an inner surface of the face panel.

When the cathode ray tube becomes in an operating state, the environmental temperature around the cathode ray tube becomes higher than the certain constant temperature due to temperature rise of a deflection yoke of the cathode ray tube and heat generation of electric circuits of the display device including the cathode ray tube. Since the generated heat is moved upward by convection of air within the display device, temperature of an upper portion of the face panel becomes higher than that of a lower portion thereof, so that the upper portion of the face panel tends to be thermally expanded easier compared with the lower portion of the face panel.

When the environmental temperature rises in this manner, the fluorescent film 11 is shifted to a position 15 and thus the predetermined film portion 11*a* is shifted to a position 15*a*. On the other hand, the shadow mask 2 is formed of invar material and the thermal expansion of the shadow mask 2 itself is very small. Therefore, the mislanding occurs necessarily.

In order to improve the amount of mislanding due to rise of the environmental temperature, the hook springs 5 arranged on the minor side wall portions 3*a* are formed of one material and the hook spring 6 arranged on the major side wall portion 3*b* is formed of another material whose temperature characteristics is different from the one material.

With this structure, when the environmental temperature rises and the face panel is thermally expanded, the hook spring 6 of bimetal arranged on the major side lower wall 3*b* of the frame 3 acts on the shadow mask 2 such that the lower portion thereof moves from its initial position toward a position 2*g* closer to the fluorescent film 11 by a distance proportional to the temperature rise. On the other hand, the upper portion of the shadow mask 2 moves from its initial position in a direction away from the fluorescent film 11 with a neutral point (P point) being a line connecting the mounting holes 5*a* of the hook springs 5 of stainless steel welded to the minor side wall portions 3*a* of the rectangular frame 3.

That is, the electron beam 25*a* passes through the through hole 2*r* of the moved shadow mask in the position 2*g* and impinges the film portion 15*a* of the moved fluorescent film 15. Therefore, the amount of mislanding is restricted.

As will be clear for those skilled in this art, since the environmental temperature variation is small in the lower portion of the display device, the thermal expansion of the shadow mask in that portion is very small. Therefore, the amount of shift from the initial position of the through-hole 2*s* to the through-hole 2*s* is negligible and thus the variation amount of mislanding is also very small.

Figure 3:
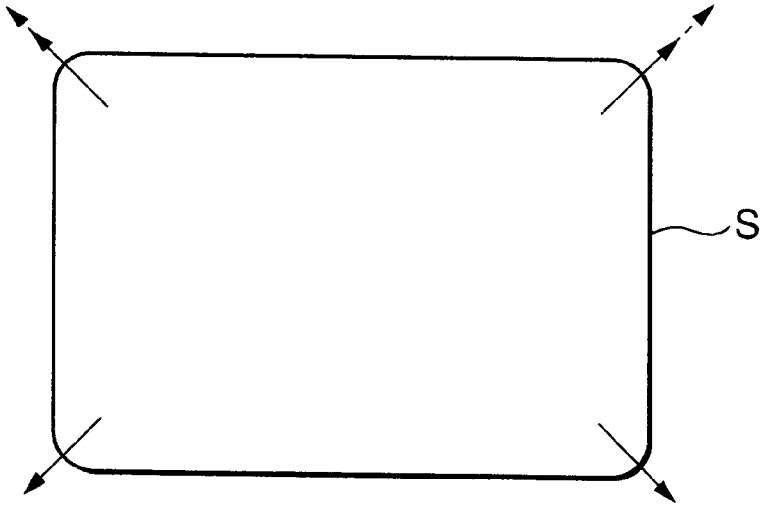
FIG. 3 is an illustration for explaining an amount of mislanding on a screen.

FIG. 3 illustrates the variation of mislanding in various portion of the shadow mask. In the conventional technique, the amount of mislanding is large in an upper portion of a screen S as shown by dotted arrows in FIG. 3, for the reason mentioned above. However, according to the present invention, the amount of mislanding is restricted to substantially the same level as that in the lower portion thereof, as shown by solid arrows.

Figure 4:
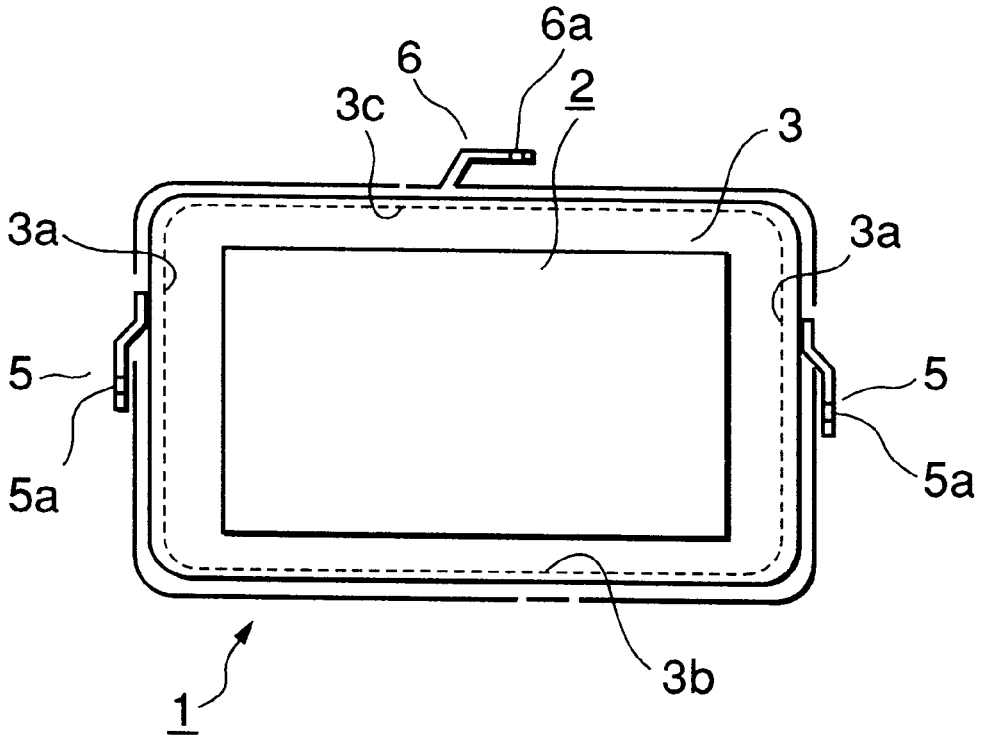
FIG. 4 is a plan view of a shadow mask structure according to a second embodiment of the present invention.
Figure 5:
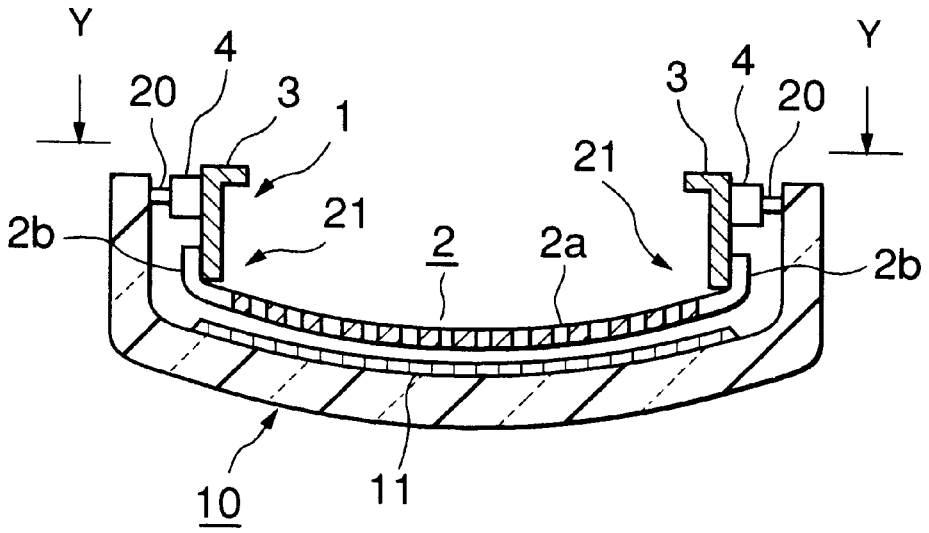
FIG. 5 is a cross section of a portion of a color cathode ray tube in which a conventional shadow mask structure mounted on a face panel of a conventional cathode ray tube.
Figure 6:
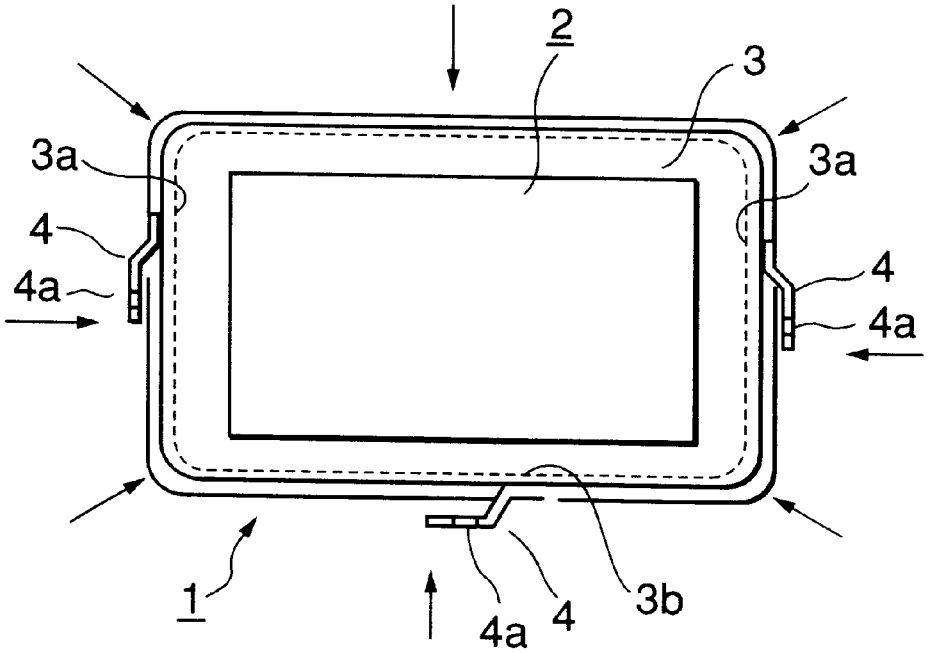
FIG. 6 is a plan view of the shadow mask structure when looked in a Y—Y direction in FIG. 5.
Figure 7:
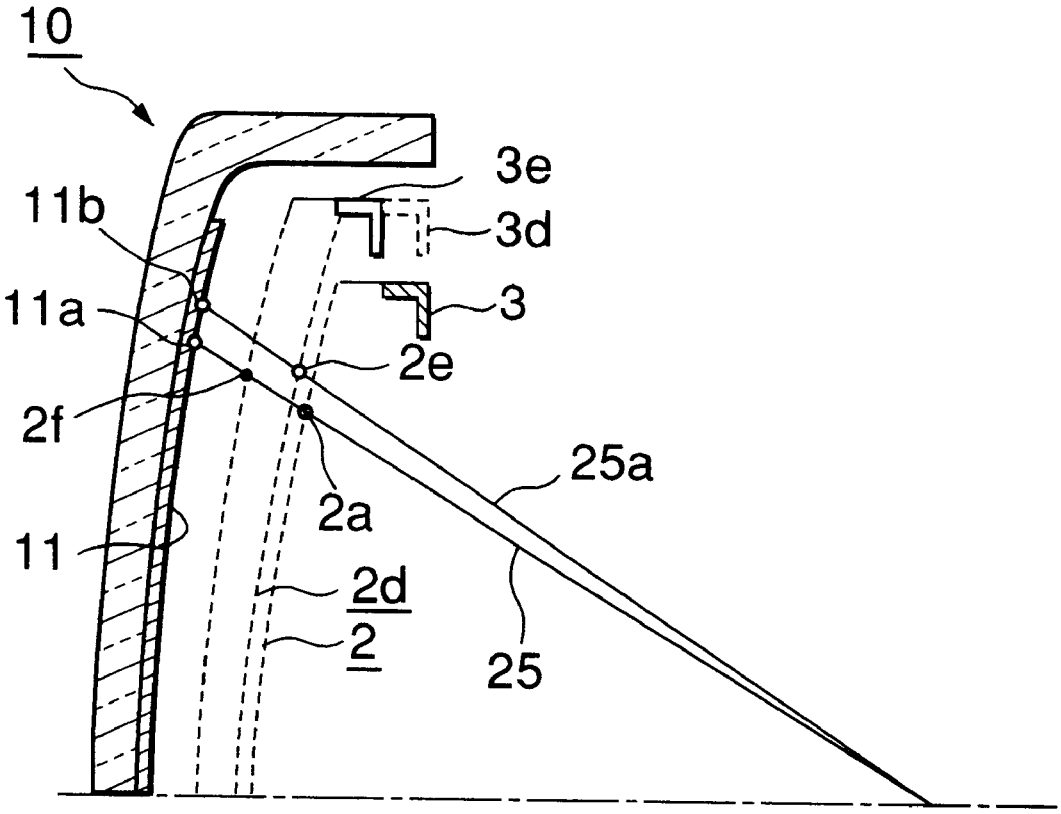
FIG. 7 is a cross section of a portion of a conventional color cathode ray tube.
Figure 8A:
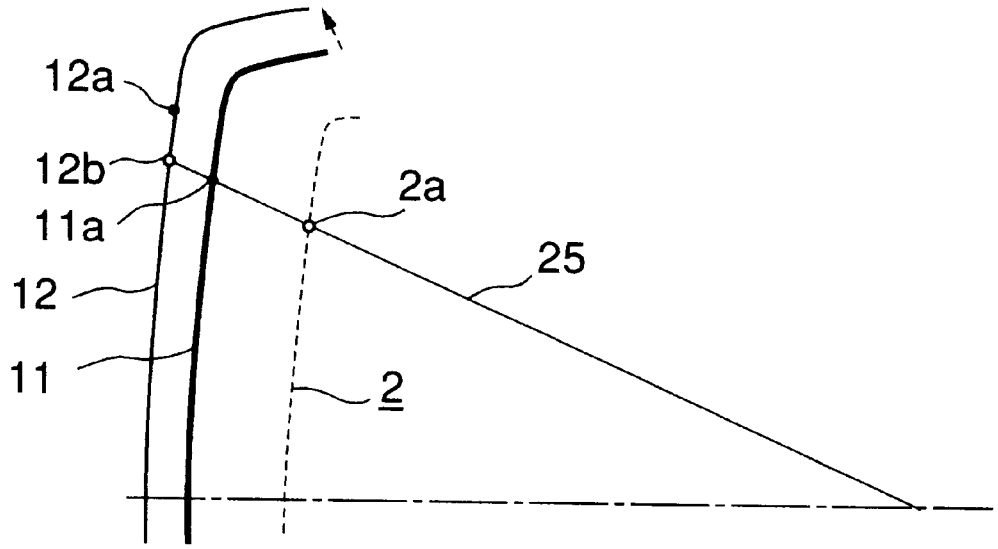
FIG. 8(*a*) is an illustration for explaining an operation principle of a conventional color cathode ray tube when an environmental temperature is higher than a reference temperature.
Figure 8B:
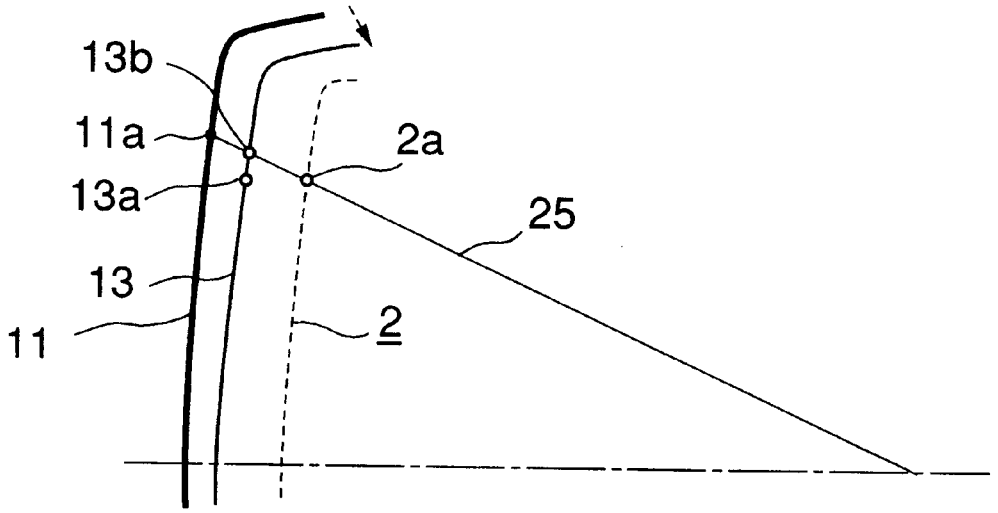

FIG. 4 is a plan view of a shadow mask structure according to a second embodiment of the present invention. The second embodiment differs from the first embodiment in that the hook spring 6 of bimetal is welded to not the major side lower wall portion 3*b* of the rectangular frame 3 but the major side upper wall portion 3*c* of the frame 3.

The operation principle of the second embodiment is basically the same as that of the first embodiment except that the hook spring 6 of bimetal acts on the shadow mask 2 such that, when the environmental temperature rises, the upper portion of the shadow mask 2 moves away from the fluorescent film 11 of the face panel 10 and, therefore, details thereof is omitted for avoidance of duplication.

In the first and second embodiments, the hook spring 6 of bimetal is provided on only one of the major side upper and lower wall portions of the rectangular frame 3, in order to make the other major side wall portion rotatable freely about the center line (P point) connecting the hook springs 5 of stainless steel arranged on the minor side wall portions 3*a* of the frame 3 when the bimetal hook spring 6 acts when the environmental temperature rises, as shown in FIG. 2.

It is of course possible, with substantially the same effect as that obtainable in the first or second embodiment, to arrange hook springs of bimetal on the minor side wall portions of the rectangular frame and a hook spring of stainless steel on one of the major side wall portions.

As described hereinbefore, according to the color cathode ray tube of the present invention, the positional relation between the fluorescent film and the shadow mask is maintained in the optimal state with respect to the thermal expansion of the face panel by providing the hook springs of stainless steel on the minor side wall portions of the rectangular frame for fixedly supporting the shadow mask and the hook spring of bimetal on one of the major side wall portions of the frame. That is, the change of the relative positional relation between the fluorescent film and the shadow mask caused by environmental temperature variation is automatically corrected to restrict and uniformize the variation amount of mislanding in the upper and lower portions of the screen to thereby realize a high quality display image on the face panel.

What is claimed is:

1. A shadow mask structure of a cathode ray tube, comprising a shadow mask provided on an inner surface of a face panel with a constant gap therebetween, a rectangular frame for fixedly supporting said shadow mask and a plurality of hook springs for fixing said frame on said face panel, said hook springs provided on minor side wall portions of said frame being formed of a material having a certain temperature characteristics and said hook spring provided on one of major side upper and lower wall portions being formed on another material having a temperature characteristics different from that of the certain temperature characteristics.

2. A shadow mask structure as claimed in claim 1, wherein said material forming said hook springs provided on said minor side wall portions is a stainless steel and said another material forming said hook spring provided on said one major side wall portion is a bimetal.

3. A shadow mask structure as claimed in claim 1, wherein said material forming said hook springs provided on said minor side wall portions is a bimetal and said another material forming said hook spring provided on said one major side wall portion is a stainless steel.

* * * * *